US005356355A

United States Patent [19]

Campbell

[11] Patent Number: 5,356,355

[45] Date of Patent: Oct. 18, 1994

[54] FULLY ADJUSTABLE INFANT WALKING AIDE

[76] Inventor: Douglas Campbell, 8008 34th Ave. South, Space 54, Tacoma, Wash. 98407

[21] Appl. No.: 152,435

[22] Filed: Nov. 12, 1993

[51] Int. Cl.[5] ..... A63B 1/00; A63B 22/00

[52] U.S. Cl. ..... 482/43; 482/69

[58] Field of Search ..... 482/43, 69, 123, 124, 482/125; 434/247, 250, 253, 255, 258; 606/241

[56] References Cited

U.S. PATENT DOCUMENTS 5,190,512 3/1993 Curran ..... 482/125

5,269,737 12/1993 Sobotka ..... 482/123

*Primary Examiner*—Richard J. Apley

*Assistant Examiner*—Lynne A. Reichard

*Attorney, Agent, or Firm*—Graybeal Jackson Haley & Johnson

[57] ABSTRACT

An infant walking aide device which helps an adult to assist a small child or toddler in learning to walk. A fully adjustable harness is supported by a crossbar which is held by the adult. The harness has straps which fit over the child's shoulders, under the child's crotch, around the child's waist, and across the child's upper back. The crossbar and suspending straps clip to the harness for easy attachment and release. The suspending straps are adjustable in length to accommodate various carrying configurations. The crossbar is width adjustable and may be grasped by either one or two adults. In addition, the crossbar is curved so that it can be placed over an adult's head and supported by the adult's neck and shoulders. Finally, a safety strap or tether attaches between the harness and the adult for use as either a leash or a safety tether providing added security.

14 Claims, 5 Drawing Sheets

FULLY ADJUSTABLE INFANT WALKING AIDE

BACKGROUND OF THE INVENTION

This invention relates generally to infant or toddler walkers and more specifically to toddler walking training devices which are supported by one or more parents or adults.

Adult supported infant walking aides are known in the art. An early example is U.S. Pat. No. 1,193,374, entitled "Baby Walker" and issued on Aug. 1, 1916 to Gilliam. This device utilized a harness with adjustable waist belts and an adjustable handle. This device, however, has no crotch support, no adjustable shoulder straps, no safety tether, and can only be operated by a single adult.

Another example is U.S. Pat. No. 1,749,999, entitled "Manually-Held Supporting Device For Assisting Children In Learning To Walk" issued on Mar. 11, 1930 to Crocker. This device provides a vest like harness along with two support straps. It has no crotch support, no shoulder strap adjustment, no support strap adjustments, and uses an inefficient lace type fastener. Further, the support straps are not releasable and there is no safety tether.

A more recent example of adult supported infant walking aides is shown by U.S. Pat. No. 5,120,287, entitled "Infant Walking Aide" and issued on Jun. 9, 1992 to Brown et al. This device shows a harness with crotch support and a bar by which an adult can support the device. However, this device presumably offers no adjustability. The harness loosely encloses the toddler. It has only a single belt strap encircling the toddler's waist and no shoulder straps. The lack of support straps makes the toddler susceptible to flipping backward or forward. The small bar handle allows the device to be operated by one hand of an adult, but it precludes other desirable configurations, such as two adults supporting the toddler simultaneously.

Clearly, there exists a need for an improved adult supported child walking aide which: 1) is fully adjustable, 2) is adaptable to many different support configurations, 3) can be supported by one or two adults (thus sharing the load), 4) prevents a toddler from flipping backwards, 5) has a harness which may be worn by a toddler when the support straps are detached, and 6) provides a safety tether for added security in dangerous areas.

SUMMARY OF INVENTION

The invention creates an infant walking aide device which helps an adult to assist a small child or toddler in learning to walk. A fully adjustable harness is supported by a crossbar which is held by the adult. The harness has straps which fit over the child's shoulders, under the child's crotch, around the child's waist, and across the child's upper back.

The crossbar and suspending straps clip to the harness for easy attachment and release. The suspending straps are adjustable in length to accommodate various carrying configurations. The crossbar is width adjustable and may be grasped by either one or two adults. In addition, the crossbar is curved so that it can be placed over an adult's head and supported by the adult's neck and shoulders. Finally, a safety strap or tether attaches between the harness and the adult for use as either a leash or a safety tether providing added security.

The fully adjustable harness includes two adjustable waist or body belts and two adjustable shoulder straps. Being fully adjustable, the harness fits snugly around the toddler's torso and precludes the toddler from falling or slipping out of the harness. Because of the snug fit, the harness may be worn by the toddler when the suspending straps and safety tether are removed. The harness is easily secured around the toddler or removed from the toddler by quick release fasteners on the waist belts.

The crossbar and suspending straps are likewise fully adjustable. The suspending straps are length adjustable to accommodate various size adults and to permit the crossbar to be placed over the adult's head and supported by the neck and shoulders. To accommodate placing the crossbar over the neck, the crossbar is curved and fully padded. Finally, the crossbar is width adjustable making it adaptable to various supporting configurations, including being supported by one hand, two hands, or by two adults.

A final attribute of the invention is the safety tether. The safety tether attaches between the harness and the adult and serves as both a child leash and as a safety line. When the crossbar and suspending straps are removed, the safety tether serves as a leash restraining the child from moving too far from the adult. When the crossbar is used, the safety tether is secured to the adult's wrist or waist. If the adult should happen to, for instance, stumble and drop the crossbar when near a cliff, hill, or other precarious location, the safety tether prevents the child from falling too far over the precipice.

Numerous embodiments of this invention are envisioned and some are described below.

DETAILED DESCRIPTION OF THE DRAWINGS

Figure 1:
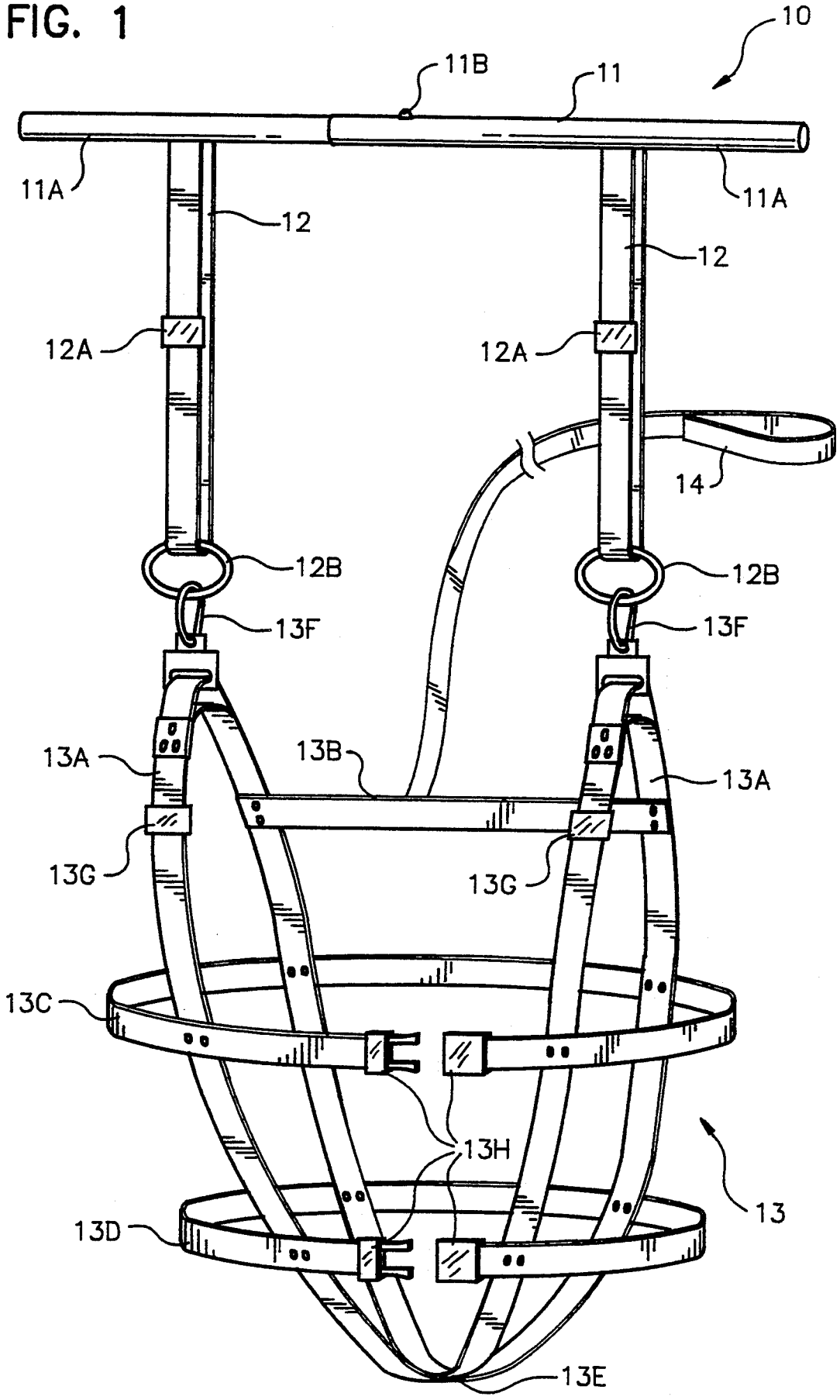
FIG. 1 shows the preferred embodiment of the invention.

FIG. 1 shows the preferred embodiment of the invention.

Toddler walking aide 10 is comprised of crossbar 11, suspending straps 12, harness 13, and safety tether 14. Harness 13 is further comprised of shoulder straps 13A, back support strap 13B, upper waist or body belt 13C, lower waist or body belt 13D, crotch straps 13E, and clips 13F.

Crossbar 11 is preferably made of lightweight tubing covered with thick foam padding. Handles 11A are formed by the crossbar extending beyond the suspending straps 12. In one embodiment, crossbar 11 is width adjustable via a conventional push button locking arrangement 11B.

Suspending straps 12 are length adjustable via fasteners 12A commonly known in the art. One end of suspending straps 12 attach to crossbar 11. A second end of suspending straps 12 easily clip to harness 13 via rings 12B and clips 13F.

Harness 13 is meant to fit snugly around a toddler and is therefore fully adjustable. Shoulder straps 13A are adjusted via shoulder strap adjustment means 13G. Similarly, waist belts 13C and 13D are adjustable via quick release buckles 13H which include strap adjustment means. Being fully adjustable permits the harness 13 to be custom fit to the toddler resulting in a high degree of security in holding the toddler. This design also allows the harness 13 to remain on the toddler when the suspending straps 12 and safety tether 14 are removed thus eliminating the cumbersome task of removing and reattaching the harness 13 each time the walking aide device 10 is to be used.

A disadvantage in the prior art is the tenency of a toddler to flip rearward. This flaw is eliminated in the current invention by the back support strap 13B. The back support strap 13B attaches between the shoulder straps 13A and is positioned high on the toddler's back. This position provides the added support to prevent a rearward flip and any associated injury. In the preferred embodiment, the back support strap 13B is also the attachment point for the safety tether 14.

The harness is constructed using materials, fasteners, and manufacturing techniques commonly known in the art. The preferred embodiment uses nylon material fastened together with rivets. It is readily recognized that many similar materials and fasteners may be substituted.

Figure 2:
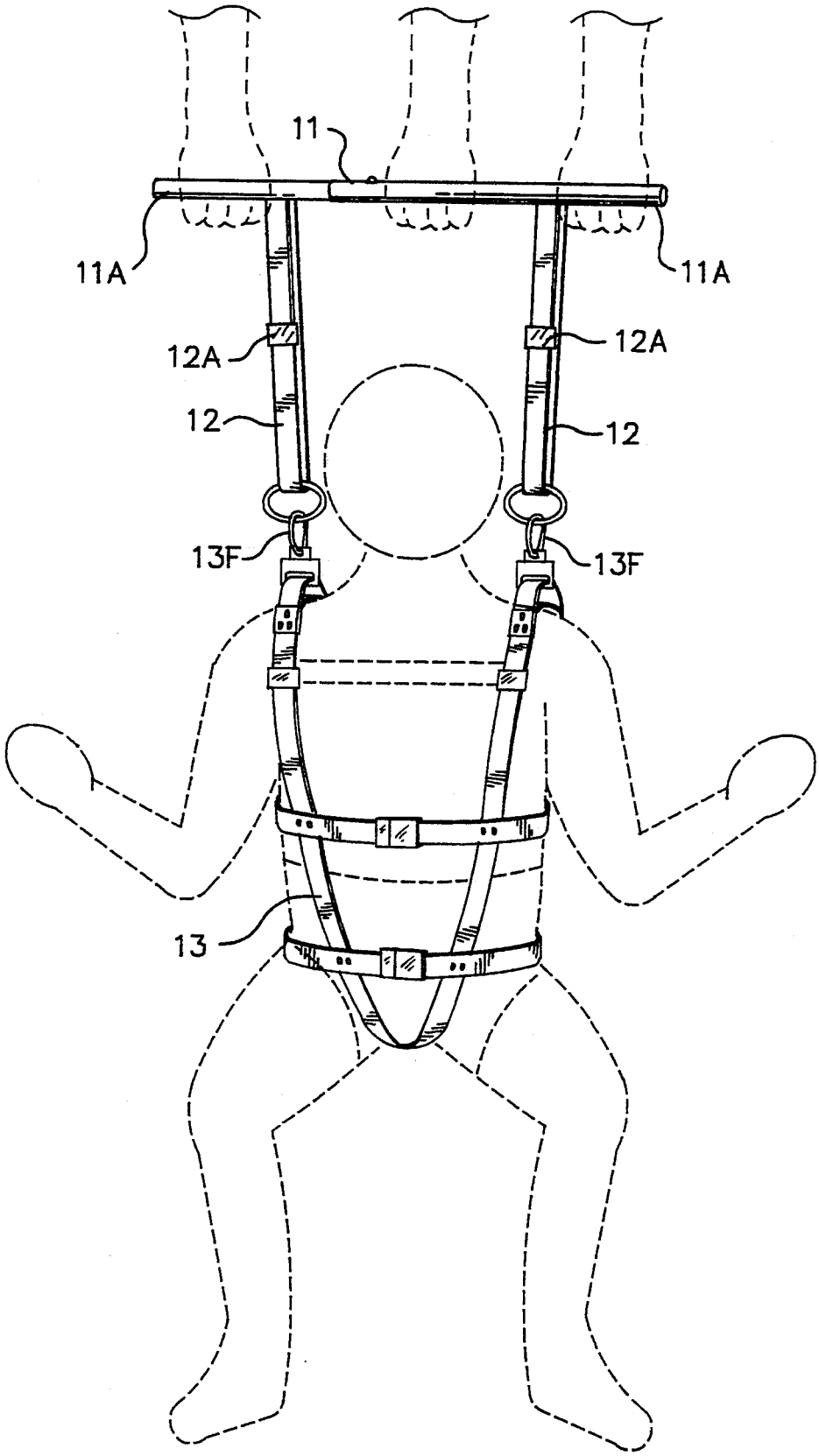
FIG. 2 shows the invention supporting a toddler and the crossbar being held by one or two hands of the operator(s).

FIG. 2 shows the invention supporting a toddler and the crossbar being held by one or two hands of the operator(s).

Crossbar 11 is grasped by either one hand in the center of the crossbar 11 or by two hands at each end of the crossbar 11. Handle portions 11A make it convenient for two adults to assist the toddler simultaneously. Suspending straps 12 attach to clips 13F and support harness 13.

Figure 3:
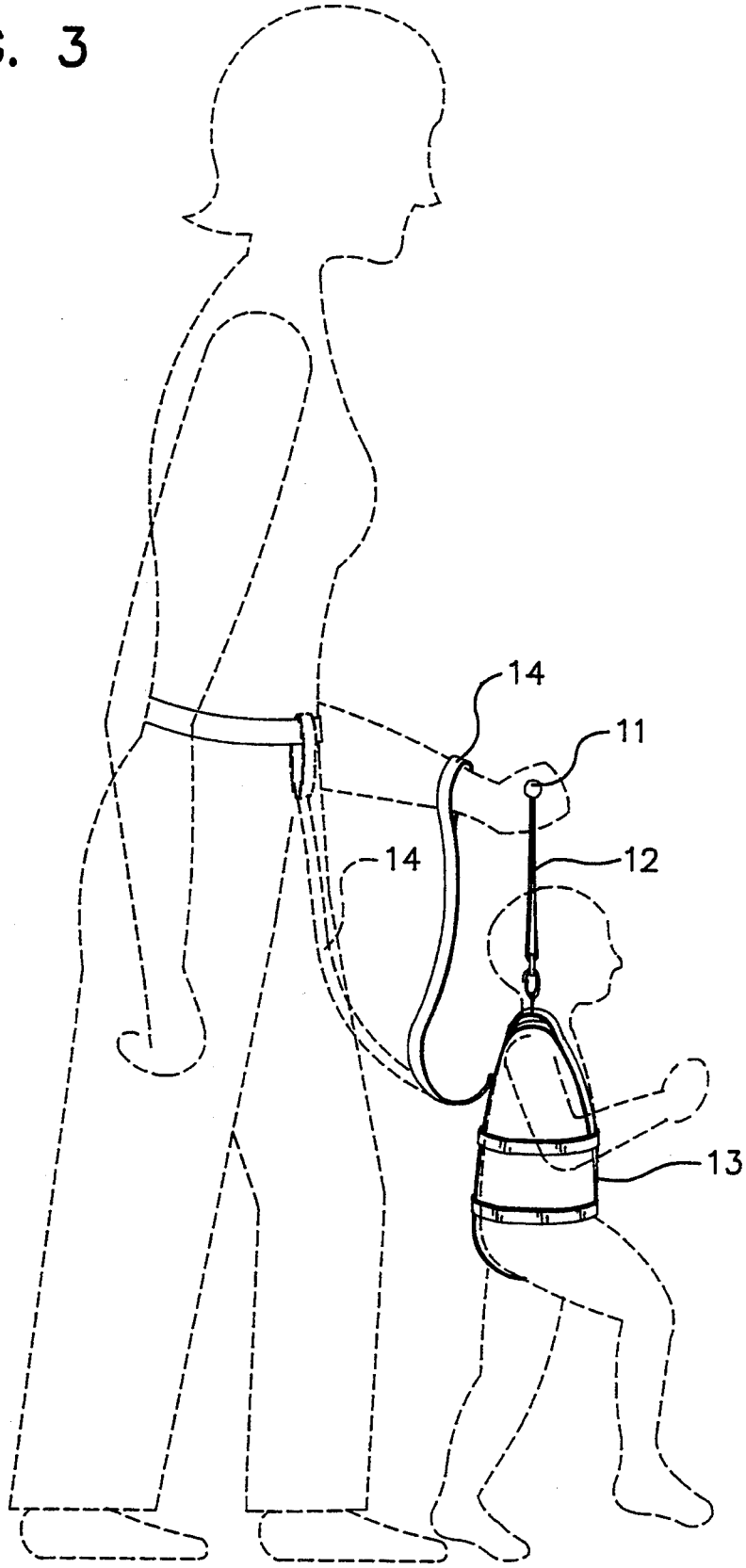
FIG. 3 shows the invention, an adult or operator, and the safety tether.

FIG. 3 shows the invention, the safety tether, and an adult operating the device.

The adult grasps the crossbar 11 providing support to the harness 13 and toddler. The safety tether 14 clips or attaches to the rear of the harness 13. The opposite end of the safety tether 14 attaches to the wrist of the adult or alternatively, to the waist of the adult. The preferred embodiment uses hook and loop fasteners (i.e. VELCRO TM) for this purpose.

Figure 4:
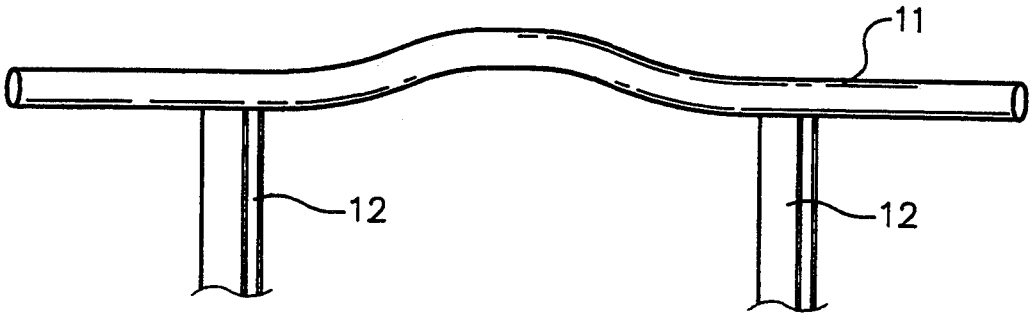
FIG. 4 shows a curved crossbar adapted for use behind the neck of the adult or operator.

FIG. 4 shows a curved crossbar adapted for use behind the neck of the adult or operator. This is useful when, for various reasons, the operator does not want to support the toddler with his/her hands. For example, when the operator is carrying something in his/her arms, doing something with his/her hands, or merely desires a different configuration.

Figure 5:
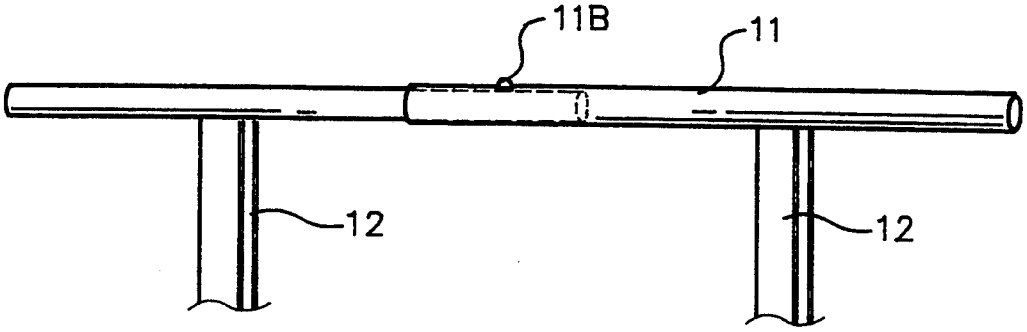
FIG. 5 is a width adjustable crossbar with a button locking mechanism.

FIG. 5 shows a width adjustable crossbar with a button locking mechanism. The width adjustment is particularly useful in shortening the crossbar 11 for a single operator, or lengthening the crossbar 11 for use by two operators.

Figure 6:
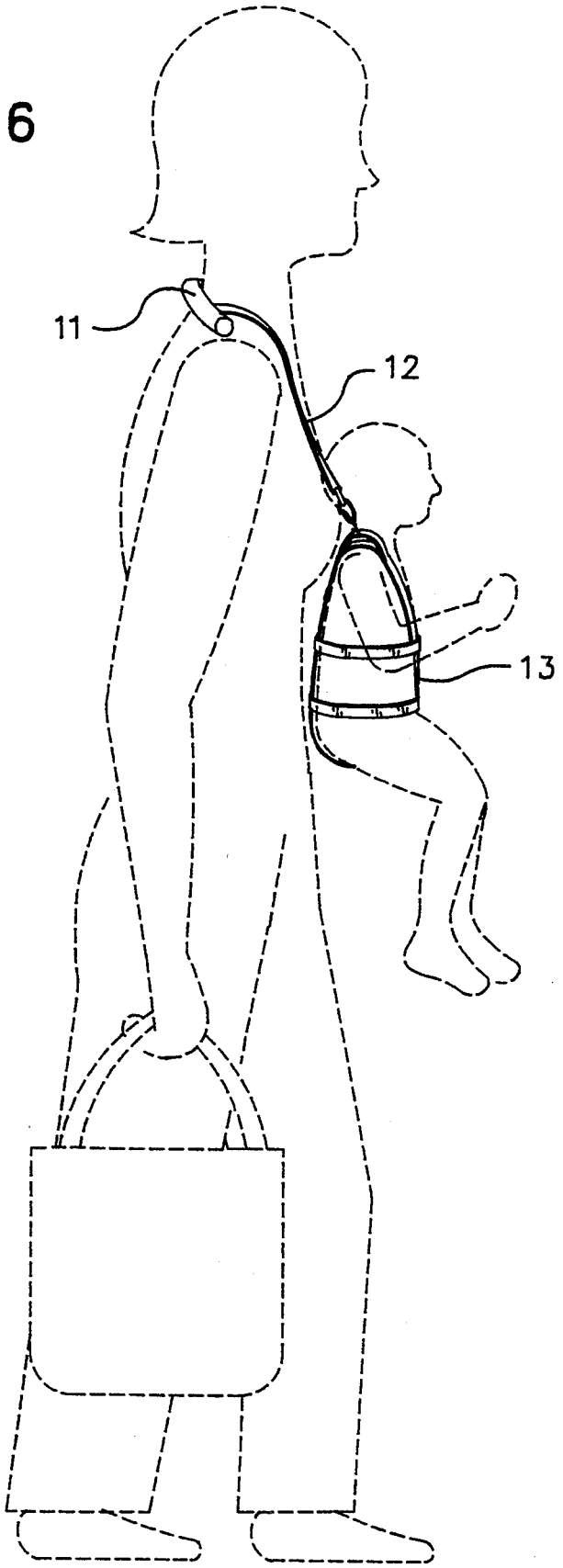
FIG. 6 shows the device used with the crossbar supported by the neck and shoulders of the operator.

FIG. 6 shows the device used with the crossbar supported by the neck and shoulders of the operator.

This configuration frees the hands of the operator while still supporting the toddler. The curved crossbar 11 rests on the operator's neck and shoulders. The suspending straps 12 are fully extended and attach to the harness 13 which supports the toddler.

The major portions of the harness 13, suspending straps 12, and safety tether 14 are preferably made of strong nylon material, however, those skilled in the art recognize that numerous other materials may be utilized. Likewise, all clips and buckles used in the toddler walking aide are preferably of the plastic or nylon quick fasten and release type commonly known in the art.

This general description of the preferred embodiment has been for descriptive purposes only and is not intended to limit the scope of the invention. Those of ordinary skill in the art readily recognize alternate embodiments including, but not limited to, using alternate materials, fasteners, buckles, and similar devices known in the art which perform substantially the same function in substantially the way.

It is clear from the foregoing that the present invention represents a new and useful device for use by an adult in assisting a toddler to walk.

What is claimed is:

1. An infant walking aide comprising:

a) a harness means for securely supporting a small child, said harness means having
   1) at least one adjustable shoulder strap,
   2) a lower adjustable body belt,
   3) an upper adjustable body belt,
   4) at least one crotch strap, and
   5) a high back belt;

b) a crossbar having a first end, a second end, and two attachment points; and c) two adjustable suspending straps connected between said crossbar and said harness means.

2. The infant walking aide according to claim 1 wherein said first end and said second end of said crossbar extend beyond said two attachment points of said crossbar forming handles.

3. The infant walking aide according to claim 2 wherein said crossbar has a pre-formed curve to facilitate supporting said crossbar by the neck of an operator.

4. The infant walking aide according to claim 3 further including a safety tether, said safety tether having a first end and a second end, said first end attached to an operator and said second end attached to said harness means.

5. The infant walking aide according to claim 1 wherein said crossbar is width adjustable.

6. A device for teaching a child to walk comprising:

a) a harness means;

b) a crossbar means having a pre-formed curved central portion for providing a handle for an operator and for supporting said device on an operator, said curved crossbar means being curved to adapt said curved crossbar means for use over the neck of an operator; and c) at least one support strap connected between said crossbar means and said harness means, said harness means configured to enclose and support a child when an operator lifts the child from the ground with said crossbar means.

7. The device for teaching a child to walk according to claim 6 wherein each end of said curved crossbar means extends beyond said strap connection points forming handles.

8. The device for teaching a child to walk according to claim 7 wherein said second end of each of said two support straps are releasably attached to said harness means.

9. The device for teaching a child to walk according to claim 8 wherein said harness means includes, a) two adjustable shoulder straps for adjusting the length of said harness means, b) at least one adjustable waist belt for adjusting the circumference of said harness means, and c) at least one crotch strap attached to said at least one of said adjustable waist belt for supporting the crotch of a child.

10. The device for teaching a child to walk according to claim 9 wherein said two support straps are adjustable as to length.

11. The device for teaching a child to walk according to claim 10 further comprising a safety tether having a first end and a second end, said first end attachable to an operator, said second end attached to said harness means.

12. The device for teaching a child to walk according to claim 11 wherein said harness means includes an upper back support strap.

13. The device for teaching a child to walk according to claim 12 wherein said curved crossbar means is adjustable as to width.

14. An infant walking training apparatus comprising:

a) a fully adjustable harness means;

b) crossbar means having a pre-formed curved central portion for providing a width adjustable handle for an operator and for supporting said device by an operator's hand or neck;

c) at least one adjustable support strap connected between said crossbar means and said harness means, said harness means configured to enclose and support a child when an operator lifts the child from the ground with said crossbar means; and d) a safety tether having a first end attachable to an operator and a second end releasably attached to said fully adjustable harness means.

* * * * *